US006886536B2

(12) United States Patent
Ranaldo et al.

(10) Patent No.: US 6,886,536 B2
(45) Date of Patent: May 3, 2005

(54) FUEL INJECTION SYSTEM OF THE COMMON RAIL TYPE WITH A VARIABLE FLOW-RATE PUMP

(75) Inventors: Sandra Ranaldo, Bologna (IT); Alberto Bastia, Genoa (IT); Paolo Pasquali, Bologna (IT); Rita Di Gioia, Zola Predossa (IT)

(73) Assignee: Magneti Marelli Powertrain S.p.A. (IT)

( * ) Notice: Subject to any disclaimer, the term of this patent is extended or adjusted under 35 U.S.C. 154(b) by 0 days.

(21) Appl. No.: 10/630,201

(22) Filed: Jul. 30, 2003

(65) Prior Publication Data

US 2004/0094128 A1 May 20, 2004

(30) Foreign Application Priority Data

Jul. 30, 2002 (IT) ..... BO2002A0498

(51) Int. Cl.[7] ..... F02M 41/00
(52) U.S. Cl. ..... 123/456
(58) Field of Search ..... 123/456, 496, 123/499, 514, 447, 506

(56) References Cited

U.S. PATENT DOCUMENTS

| | | | | |
|---|---|---|---|---|
| 5,417,194 A | | 5/1995 | Augustin | |
| 5,511,528 A | | 4/1996 | Iwanaga et al. | |
| 6,116,870 A | | 9/2000 | Kraemer | 417/490 |
| 6,131,548 A | * | 10/2000 | Yano | 123/456 |
| 6,230,684 B1 | | 5/2001 | Furuhashi et al. | |
| 6,651,630 B2 | * | 11/2003 | Hiraku et al. | 123/506 |
| 6,701,898 B2 | * | 3/2004 | Tokuo et al. | 123/456 |
| 6,725,837 B2 | * | 4/2004 | Hiraku et al. | 123/436 |

FOREIGN PATENT DOCUMENTS

| | | |
|---|---|---|
| EP | 0481964 | 12/1997 |
| EP | 0 979 940 A2 | 2/2000 |
| EP | 0979940 | 2/2000 |
| EP | 1162365 | 12/2001 |
| EP | 1 162 365 A1 | 12/2001 |
| EP | 1188919 | 3/2002 |
| EP | 1 188 919 A2 | 3/2002 |

* cited by examiner

*Primary Examiner*—Mahmoud Gimie
(74) *Attorney, Agent, or Firm*—Ostrolenk, Faber, Gerb & Soffen, LLP

(57) ABSTRACT

Fuel injection system of the common rail type provided with a high-pressure pump, which supplies fuel to a common channel that in turn supplies a series of injectors, and with a control unit, which is capable of keeping the pressure of the fuel within the common channel, moment by moment, equal to a desired value that generally varies over time; the control unit is coupled to a device for regulating the flow rate of the high-pressure pump in order to control the flow rate of the high-pressure pump so as to supply the common channel, moment by moment, with the amount of fuel required in order to have the desired value for pressure inside said common channel.

7 Claims, 2 Drawing Sheets

FUEL INJECTION SYSTEM OF THE COMMON RAIL TYPE WITH A VARIABLE FLOW-RATE PUMP

The present invention relates to a fuel injection system of the common rail type.

BACKGROUND OF THE INVENTION

In current fuel injection systems of the common rail type, a low-pressure pump supplies the fuel from a tank to a high-pressure pump, which in turn supplies the fuel to a common channel (known in jargon as a "common rail"). The common channel is connected to a series of injectors (one for each cylinder of the engine), which are actuated cyclically in order to inject part of the fuel under pressure present in the common channel into a respective cylinder. In order for the injection system to operate correctly it is important that the value for the pressure of the fuel inside the common channel is kept, moment by moment, equal to a desired value that generally varies over time; for this purpose, the high-pressure pump has dimensions for supplying the common channel, in all operating conditions, with an amount of fuel exceeding the actual consumption and the common channel is coupled to a pressure regulator that keeps the value for the pressure of the fuel inside the common channel equal to a desired value that generally varies over time, discharging the excess fuel to a recirculation channel that reintroduces said excess fuel upstream of the low-pressure pump.

Known injection systems of the type described above have various disadvantages, in that the high-pressure pump must have dimensions for supplying the common channel with an amount of fuel slightly exceeding the maximum possible consumption; however, this condition of maximum possible consumption proves fairly rare and in all other operating conditions the amount of fuel supplied to the common channel is much greater than the actual consumption and therefore a significant proportion of this fuel has to be discharged by the pressure regulator into the recirculation channel. Clearly, the work performed by the high-pressure pump in order to pump fuel that is subsequently discharged by the pressure regulator is "useless" work, therefore known injection systems have very low energy efficiency. Moreover, known injection systems tend to overheat the fuel, in that when the excess fuel is discharged by the pressure regulator into the recirculation channel, said bars) to substantially ambient pressure and because of this jump in pressure its temperature tends to increase.

Finally, known injection systems of the type described above are relatively expensive and cumbersome because of the presence of the pressure regulator.

In order to resolve the problems described above at least partly, it has been proposed to use a high-pressure pump with more cylinders, provided with a regulation device capable of excluding one or more cylinders as a function of the engine point so as to reduce the amount of excess fuel. However, this solution proves complicated and expensive and is only able to resolve some of the problems of energy consumption and overheating connected with the presence of excess fuel.

Another solution to the problems described above has been proposed by patent application EP-0481964-A1, which describes the use of a high-pressure pump provided with an electromagnetic actuator capable of varying the flow rate of said pump, moment by moment; however, the methods for controlling the flow rate of the high-pressure pump proposed by patent application EP-0 481 964-A1 are not able to guarantee optimal operation of the injection system in every operating condition.

Moreover, the high-pressure pump proposed by EP-0481964-A1 is structurally complicated and expensive; therefore patent U.S. Pat. No. 6,116,870-A1 proposes another embodiment of a high-pressure pump with variable flow rate. In particular, the high-pressure pump described by U.S. Pat. No. 6,116,870-A1 comprises a cylinder provided with a piston having alternating motion inside the cylinder, an intake channel, a discharge channel connected to the common channel, an intake valve capable of allowing a flow of fuel to pass into the cylinder, a single-direction delivery valve coupled to the discharge channel and capable of allowing a flow of fuel only out of the cylinder, and a regulation device coupled to the intake valve in order to keep the intake valve open when the piston is in a compression phase and therefore to permit a flow of fuel out of the cylinder through the intake valve; the intake valve comprises a valve body moveable along the intake channel and a valve seat, which is capable of being acted upon in a fluid-tight manner by the valve body and is arranged at the end of the intake channel opposite the end communicating with the cylinder; and the regulation device comprises a control member, which is coupled to the valve body and is moveable between a passive position, in which it allows the valve body to act in a fluid-tight manner on the valve seat, and an active position, in which it does not allow the valve body to act in a fluid-tight manner on the valve seat, and an electromagnetic actuator, which is coupled to the control member in order to move the control member between the passive position and the active position.

However, the high-pressure pump proposed by patent U.S. Pat. No. 6,116,870-A1 also has some disadvantages, particularly owing to the cost and electric power consumption of the electromagnetic actuator coupled to the control member.

EP-1188919-A1 discloses a fuel supply system for a direct injection engine which has a variable capacity single cylinder plunger pump and two fuel rails. There are disposed orifices at the upstream side inlets of the both fuel rails, respectively; at the opposite sides to the inlet sides, the fuel rails are interconnected with each other by a connecting pipe. By the fuel supply system, it is capable of increasing a characteristic frequency of the fuel columns, and of stabilizing, suppressing, and smoothing out pressure pulsation in the fuel rails, thereby reducing uneven fuel injections into the cylinders; the system may have a cam which drives a plunger of a high pressure fuel pump to reciprocate once for every two combustion in two engine cylinders.

EP-1162365-A1 discloses a high-pressure fuel feed pump for an internal combustion engine; an intake valve automatically opened and closed by pressure of a pressuring chamber is provided in a fuel intake passage, the intake valve is pushed to open by a plunger of an electromagnetic plunger mechanism, pulling-in operating timing of the plunger is controlled according to the operating condition of an internal combustion engine, and opening time of the intake valve during compression stroke of a pump is controlled to make discharge flow-rate of high pressure fuel variable.

EP-0979940-A1 discloses a device for controlling fuel injection into an internal combustion engine is disclosed; the device comprises an accumulator for supplying pressurized fuel to a fuel injection valve, a high-pressure pump for discharging fuel into the accumulator using the engine as a power source, and a low-pressure pump for discharging fuel into the high-pressure pump using a power source other than the engine. At the start of the engine, the fuel discharged from the low-pressure pump is substantially directly introduced into the accumulator through a pump chamber of the high-pressure pump; to elevate the pressure within the accumulator for a short period to a fuel pressure capable of injecting fuel at the start of the engine, an opening and closing valve is provided in a suction passage that communicates the discharge side of the low-pressure pump with the suction side of the high-pressure pump, and is maintained to be opened at the start of the engine.

SUMMARY OF THE INVENTION

The aim of the present invention is to produce a fuel injection system of the common rail type that does not have the disadvantages described above and, in particular, is easy and economical to implement.

According to the present invention a fuel injection system of the common rail type is produced as established by claim 1.

According to the present invention, moreover, a high-pressure pump is produced for a fuel injection system of the common rail type as established by claim 13.

BRIEF DESCRIPTION OF THE DRAWINGS

The present invention will now be described with reference to the attached drawings, which illustrate a non-exhaustive embodiment thereof, in which.

DETAILED DESCRIPTION OF THE INVENTION

Figure 1:
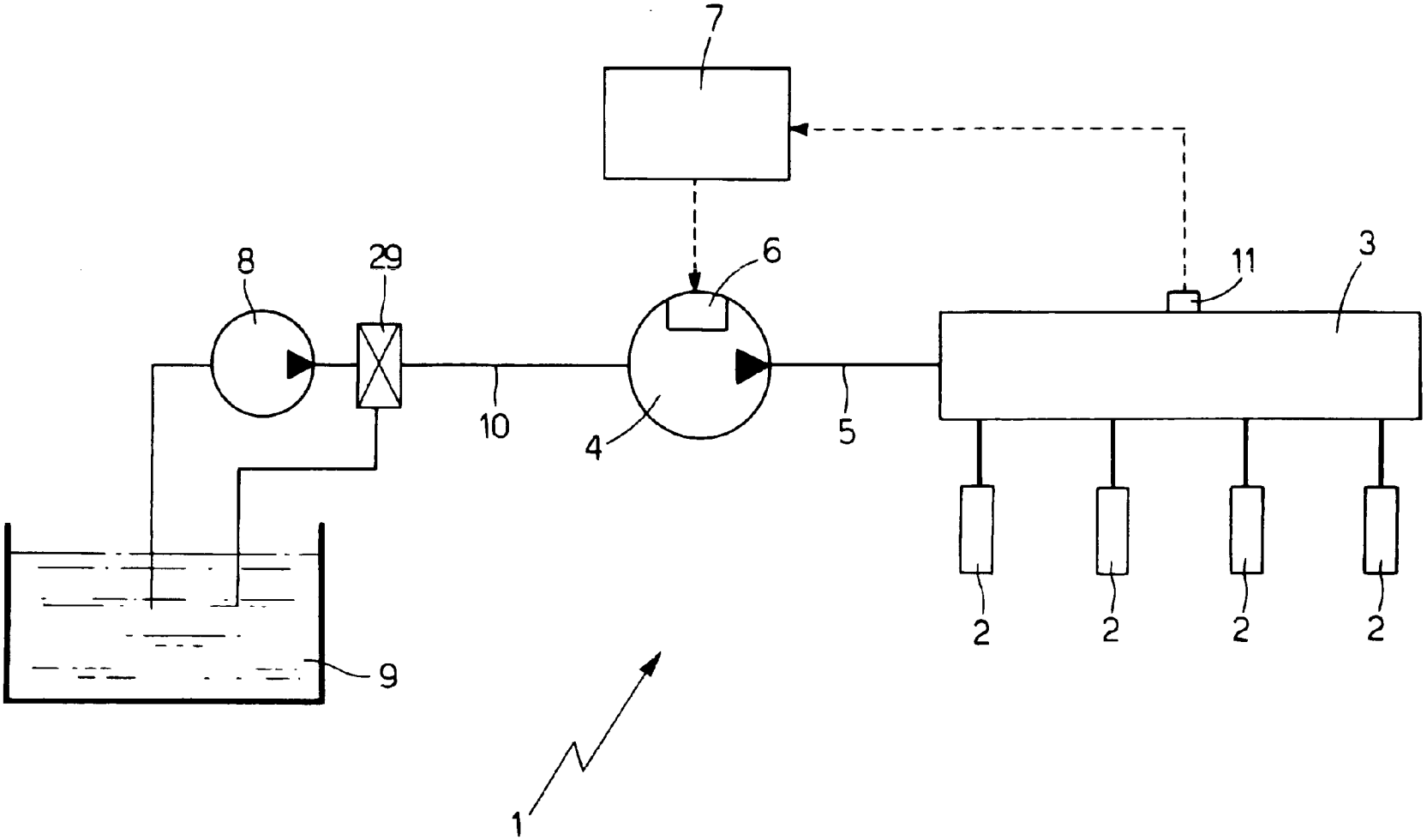
FIG. 1 is a diagrammatic view of a fuel injection system of the common rail type produced in accordance with the present invention.

In FIG. 1, the reference number 1 indicates as a whole a fuel injection system of the common rail type comprising a plurality of injectors 2, a common channel 3 (known in jargon as a "common rail") that supplies fuel under pressure to the injectors 2, a high-pressure pump 4, which supplies fuel to the common channel 3 by means of a tube 5 and is provided with a device 6 for regulating the flow rate, a control unit 7 capable of keeping the pressure of the fuel inside the channel 3 equal to a desired value that generally varies over time as a function of the operating conditions of the engine, and a low-pressure pump 8 that supplies fuel from a tank 9 to the high-pressure pump 4 by means of a tube 10.

The control unit 7 is coupled to the regulation device 6 in order to control the flow rate of the high-pressure pump 4 so as to supply the common channel 3, moment by moment, with the amount of fuel required in order to have the desired value for pressure inside said common channel 3; in general, the amount of fuel required in order to have the desired value for pressure inside the common channel 3 is given by the algebraic sum of the amount of fuel actually absorbed from the injectors 2 (equal to the sum of the amount of fuel injected by the injectors 2 and the amount of fuel recirculated by the injectors 2), the amount of fuel used by the pump 4 for lubrication and/or cooling, the amount of fuel that is drawn by the pump 4, and the amount of fuel (positive or negative) required in order to change the value for the pressure inside the common channel 3 from the current value to the desired value The control unit 7 is capable of regulating the flow rate of the high-pressure pump 4 solely by means of a feedback control using as a feedback variable the value for the pressure of the fuel inside the common channel 3, the value for pressure recorded in real time by a sensor 11.

Figure 2:
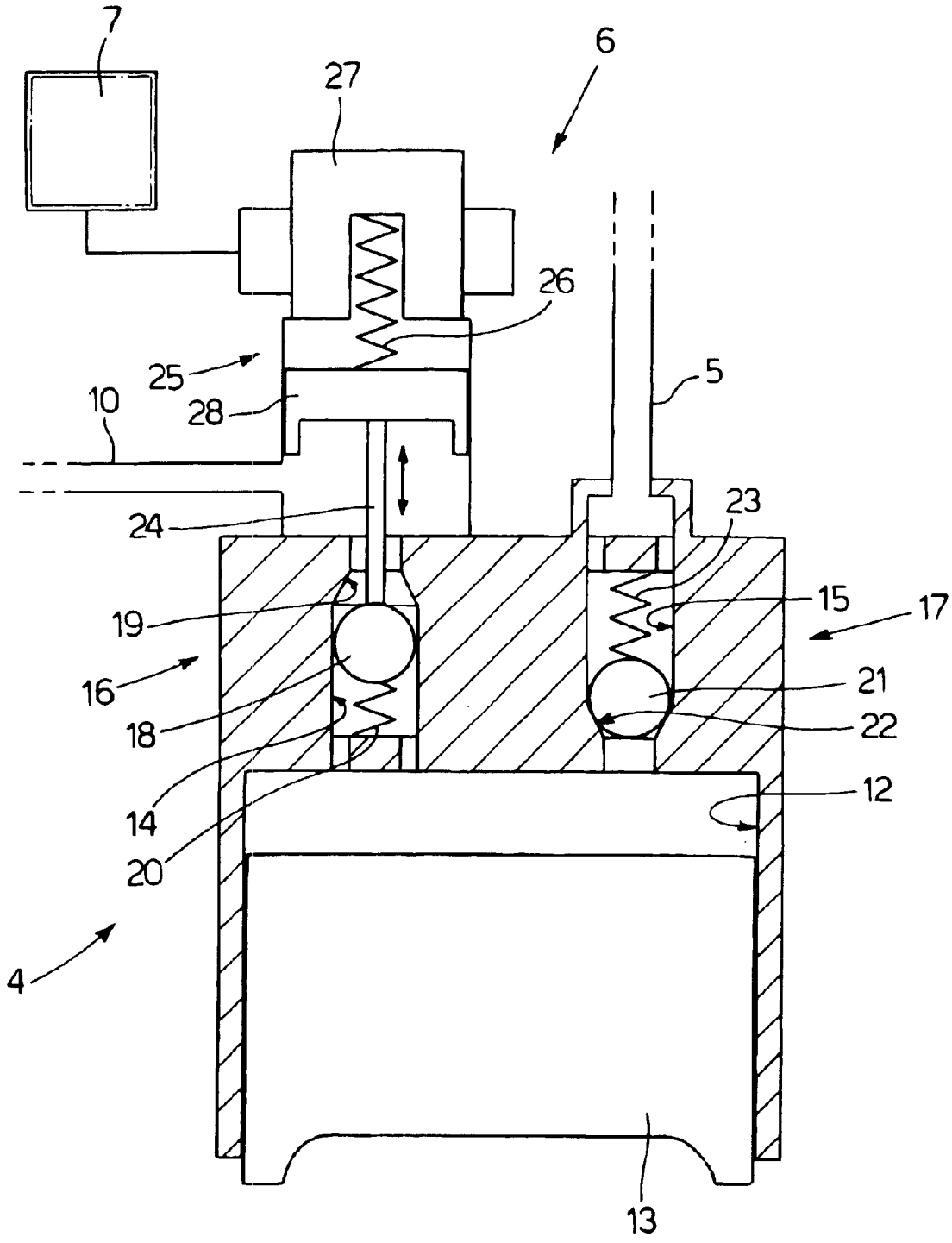
FIG. 2 is a diagrammatic view in lateral section of a high-pressure pump of the system in FIG. 1.

As illustrated in FIG. 2, the high-pressure pump 4 comprises a cylinder 12 provided with a piston 13 having an alternating motion inside the cylinder 12, an intake channel 14 connected to the low-pressure pump 8 by means of the tube 10, a discharge channel 15 connected to the common channel 3 by means of the tube 5, an intake valve 16 coupled to the intake channel 14 and capable of allowing the passage of a flow of fuel into the cylinder 12, and a single-direction delivery valve 17 coupled to the discharge channel 15 and capable of allowing only a flow of fuel out of the cylinder 12.

The intake valve 16 comprises a valve body 18 moveable along the intake channel 14 and a valve seat 19, which is capable of being acted upon in a fluid-tight manner by the valve body 18 and is arranged at the end of the intake channel 14 opposite the end communicating with the cylinder 12; a spring 20 is capable of pushing the valve body 18 towards a fluid-tight engaged position of the valve seat 19. The intake valve 16 is normally controlled in terms of pressure, in that the forces originating from the differences in pressure at the heads of the intake valve 16 are much greater than the force generated by the spring 20; in particular, in the absence of external action, the intake valve 16 is closed when the pressure of the fuel inside the cylinder 12 is higher than the pressure of the fuel inside the tube 10 and is open when the pressure of the fuel inside the cylinder 12 is lower than the pressure of the fuel inside the tube 10.

The delivery valve 17 comprises a valve body 21 moveable along the discharge channel 15 and a valve seat 22, which is capable of being acted upon in a fluid-tight manner by the valve body 21 and is arranged at the end of the discharge channel 15 communicating with the cylinder 12; a spring 23 is capable of pushing the valve body 21 towards a fluid-tight engaged position of the valve seat 22. The delivery valve 17 is controlled in terms of pressure, in that the forces originating from the differences in pressure at the heads of the delivery valve 17 are much greater than the force generated by the spring 23; in particular, in the absence of external action, the delivery valve 17 is open when the pressure of the fuel inside the cylinder 12 is higher than the pressure of the fuel inside the tube 5 and is closed when the pressure of the fuel inside the cylinder 12 is lower than the pressure of the fuel inside the tube 5

The regulation device 6 is coupled to the intake valve 16 in order to allow the control unit 7 to keep the intake valve 16 open when the piston is in a compression phase 13 and therefore to allow a flow of fuel out of the cylinder 12 through the intake channel 14. The regulation device 6 comprises a push rod 24, which is coupled to the valve body 18 of the intake valve 16 and is moveable along a linear distance parallel to the direction of flow of the fuel through the intake channel 14 between a passive position, in which it allows the valve body 18 to act in a fluid-tight manner on a respective valve seat 19, and an active position, in which it does not allow the valve body 18 to act in a fluid-tight manner on the respective valve seat 19. The regulation device 6 also comprises an electromagnetic actuator 25, which is coupled to the push rod 24 in order to move the push rod 24 between the active position and the passive position. The electromagnetic actuator 25 comprises a spring 26 capable of keeping the push rod 24 in the active position, and an electromagnet 27 driven by the control unit 7 and capable of moving the push rod 24 into the passive position, magnetically attracting a ferromagnetic armature 28 integral with the push rod 24; in particular, when the electromagnet 27 is excited, the push rod 24 is returned to the aforementioned passive position and the intake channel 14 can be closed by the intake valve 16.

The spring 26 of the electromagnetic actuator 25 exerts a greater force than the spring 20 of the intake valve 16, therefore in rest conditions (i.e., in the absence of significant hydraulic forces and with the electromagnet 27 de-excited) the rod 24 is arranged in its active position and the intake valve 16 is open (i.e. it is a valve that is normally open). In contrast, in rest conditions (i.e., in the absence of significant hydraulic forces) the delivery valve 17 is closed (i.e. it is a valve that is normally closed).

According to the embodiment illustrated in FIG. 2, the rod 24 bears against the valve body 18 of the intake valve 16, which is pushed towards the rod 24 by the action of the spring 20. According to another embodiment, not illustrated, the rod 24 is integral with the valve body 18 and the spring 20 can be eliminated In use, during the downward stroke of the cylinder 13, that is, during the intake phase, a partial vacuum is generated inside the cylinder 12 and a predetermined, constant amount of fuel equal to the volume of the piston displacement of the cylinder 12 is supplied through the intake channel 14 inside the cylinder 12. This amount of fuel normally exceeds the amount of fuel required in order to have the desired value for pressure inside the common channel 3 and must therefore be partly discharged, in order to supply the common channel 3 only with the amount of fuel required in order to have the desired value for pressure inside the common channel 3.

Once the piston 13 has reached its bottom dead centre, the piston 13 inverts the direction of its stroke and begins its upward stroke; in an initial phase of the upward stroke, the control unit 7 does not cause the intake valve 16 to close, and it therefore remains open. In this way, the pressure inside the cylinder 12 does not reach values that will allow the delivery valve 17 to open, and part of the fuel leaves the cylinder 12, flowing through the intake channel 14; when the amount of fuel that exceeds the amount of fuel required in order to have the desired value for pressure inside the common channel 3 has left the cylinder 12 through the intake channel 14, the control unit 7 drives the regulation device 6 in order to take the push rod 24 to its passive position and therefore to allow the intake valve 16 to close because of the consequent increase in pressure of the fuel inside the cylinder 12. At this point, there is inside the cylinder 12 exactly the amount of fuel required in order to have the desired value for pressure inside the common channel 3; the pressure inside the cylinder 12 rises through the effect of the upward stroke of the piston 13 until it reaches values that will open the delivery valve 17 and therefore allow the fuel inside the cylinder 12 to be supplied under pressure to the common channel 3. From the description above, it is clear that the exact amount of fuel is supplied to the common channel 3 at each pumping cycle that is required in order to have the desired value for pressure inside the common channel 3, therefore the value for the pressure of the fuel inside the common channel 3 is regulated in order to be kept equal to the desired value.

In order to vary the amount of fuel supplied by the high-pressure pump 4 to the common channel 3, that is, in order to vary the flow rate of the high-pressure pump 4, the control unit 7 varies the amount of fuel discharged through the intake channel 14, that is, it varies the moment at which it drives the regulation device 6 in order to move the push rod 24 from the active position to the passive position; as stated previously, the control unit 7 varies the moment at which it drives the regulation device 6 by means of a feedback control using as a feedback variable the value for the pressure of the fuel inside the common channel 3, the value for pressure recorded in real time by the sensor 11.

It is important to note that the control unit 7 can control the electromagnet 27 with a pulse of current of limited and constant duration (for example, less than 2 msec when the piston 13 is actuated at 3000 rpm); in fact, once the electromagnet 27 has taken the push rod 24 to the passive position, attracting the armature 28 to itself, the intake valve 16 closes and a relatively high pressure is generated almost instantaneously inside the cylinder 12, which pressure exerts on the valve body 18 of the intake valve 16 a force significantly greater than that exerted by the spring 26 of the actuator 25. Therefore, if the electromagnet 27 also ceases to act, the spring 26 of the actuator 25 is not capable of reopening the intake valve 16 until the pressure inside the cylinder 12 has fallen to relatively low values, that is, until the beginning of the next intake phase of the cylinder 13. The fact of actuating the electromagnet 27 with a pulse of current of limited and constant duration is decidedly advantageous, in that it allows energy consumption by the electromagnet 27 to be limited to the absolute minimum, it allows the costs of the respective electrical circuits to be reduced since they can have dimensions suitable for working with very low dissipated electric power, and it allows the drive circuits of the electromagnet 27 to be simplified.

According to a preferred embodiment, an overpressure valve 29 is inserted along the tube 10 downstream from the low-pressure pump 8, which overpressure valve serves to discharge the fuel from the tube 10 to the tank 9 when the pressure inside the tube 10 exceeds a given threshold value through the effect of the return flow of the fuel from the cylinder 12. The function of the overpressure valve 29 is to prevent the pressure inside the tube 10 from reaching relatively high values that could, over time, lead to the breakage of the low-pressure pump 8.

What is claimed is:

1. Fuel injection system of the common rail type comprising:

a plurality of injectors, a common channel that supplies the fuel under pressure to the injectors, a high-pressure pump, which supplies fuel to the common channel and is provided with a device for regulating the flow rate and a control unit capable of keeping the pressure of the fuel within the common channel, moment by moment, equal to a desired value that generally varies over time;

the control unit being coupled to the regulation device in order to control the flow rate of the high-pressure pump so as to supply the common channel, moment by moment, with the amount of fuel required in order to have the desired value for pressure inside said common channel;

the control unit comprising a sensor that is capable of recording the value for the pressure of the fuel inside the common channel, and is capable of regulating the flow rate of the high-pressure pump by means of a feedback control using as a feedback variable the value for the pressure of the fuel inside the common channel;

the high-pressure pump comprising at least one cylinder provided with a piston having an alternating motion inside the cylinder, an intake channel, a discharge channel connected to the common channel, an intake valve coupled to the intake channel and capable of allowing a flow of fuel to pass into the cylinder, and a single-direction delivery valve coupled to the discharge channel and capable of allowing a flow of fuel only out of the cylinder;

the regulation device being coupled to the intake valve in order to keep the intake valve open when the piston is in a compression phase and therefore to allow fuel to flow back out of the cylinder through the intake channel; the intake valve comprising a valve body moveable along the intake channel and a valve seat that is capable of being acted upon in a fluid-tight manner by the valve body and is arranged at the end of the intake channel opposite the end communicating with the cylinder;

the regulation device comprising a control member that is coupled to the valve body and is moveable between a passive position, in which it allows the valve body to act in a fluid-tight manner upon the valve seat, and an active position, in which it does not allow the valve body to act in a fluid-tight manner upon the valve seat;

the regulation device comprising an electromagnetic actuator that is coupled the control member in order to move said control member between the passive position and the active position;

the electromagnetic actuator comprising a spring capable of keeping the control member in the active position, and an electromagnet capable of moving the control member into the passive position;

wherein the force exerted by the spring of the actuator is significantly less than the force exerted by the pressure on the valve body of the intake valve; and wherein the control unit comprises control means for driving the electromagnetic actuator by means of a pulse of current of short and constant duration.

2. System according to claim 1, in which the intake valve is open and the delivery valve is closed when the cylinder is in an intake phase in order to supply the cylinder with a given, constant amount of fuel, while the intake valve is closed and the delivery valve is open when the cylinder is in a delivery phase in order to supply fuel under pressure to the common channel; the control unit being capable of keeping the intake valve open during an initial part of the delivery phase of the cylinder in order to discharge through the intake conduit the amount of fuel present in the cylinder that exceeds the amount of fuel required in order to have the desired value for pressure inside said common channel.

3. System according to claim 1, in which the intake valve comprises a respective spring capable of pushing the valve body towards a fluid-tight engaged position of the valve seat.

4. System according to claim 1, in which the control member is moveable between the active position and the passive position along a linear distance parallel to the direction of flow of the fuel through the intake channel.

5. System according to claim 1, in which the delivery valve comprises a valve body moveable along the discharge channel and a valve seat that is capable of being acted upon in a fluid-tight manner by the valve body and is arranged at the end of the discharge channel communicating with the cylinder.

6. System according to claim 5, in which the delivery valve comprises a respective spring capable of pushing the valve body towards a fluid-tight engaged position of the valve seat.

7. System according to claim 1, comprising a low-pressure pump capable of supplying the fuel from a tank to the high-pressure pump by means of a tube, along which an overpressure valve connected to the tank is inserted.

* * * * *

UNITED STATES PATENT AND TRADEMARK OFFICE

CERTIFICATE OF CORRECTION

PATENT NO. : 6,886,536 B2
DATED : May 3, 2005
INVENTOR(S) : Ranaldo et al.

It is certified that error appears in the above-identified patent and that said Letters Patent is hereby corrected as shown below:

Title page,
Item [75], Inventors, should be -- Rita Di Gioia, Zola Predosa (IT) --.

Signed and Sealed this

Thirtieth Day of August, 2005

JON W. DUDAS
*Director of the United States Patent and Trademark Office*